US006453834B1

(12) United States Patent
Tajima et al.

(10) Patent No.: US 6,453,834 B1
(45) Date of Patent: Sep. 24, 2002

(54) POWER TRANSMISSION DEVICE FOR SEWING MACHINE

(75) Inventors: Ikuo Tajima; Mitsunori Matsumoto, both of Kasugai (JP)

(73) Assignee: Tokai Kogyo Mishin Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 09/513,214

(22) Filed: Feb. 24, 2000

(30) Foreign Application Priority Data

Feb. 26, 1999 (JP) ..... 11-50899

(51) Int. Cl.[7] ..... D05B 69/02
(52) U.S. Cl. ..... 112/220
(58) Field of Search ..... 112/220, 221, 112/163, 164, 167, 181

(56) References Cited

U.S. PATENT DOCUMENTS 63,266 A * 3/1867 Lewis et al.
1,443,793 A * 1/1923 McCann
2,279,628 A * 4/1942 Marsack ..... 112/117
2,718,790 A * 9/1955 Hughey
2,741,198 A * 4/1956 Attwood et al. ..... 112/220
2,758,558 A * 8/1956 Waterman ..... 112/220 X
3,365,966 A * 1/1968 Heyer
3,685,098 A * 8/1972 Lapeyre
4,467,737 A * 8/1984 Breck, Jr. ..... 112/220 X
4,669,405 A * 6/1987 Resta et al. ..... 112/119 X
5,121,648 A * 6/1992 Seiler
5,167,195 A * 12/1992 Guerreschi ..... 112/163 X

* cited by examiner

*Primary Examiner*—Ismael Izaguirre
(74) *Attorney, Agent, or Firm*—Lyon & Lyon LLP

(57) ABSTRACT

A power transmission device serves to transmit rotation of a main shaft of a sewing machine to a slave shaft of the sewing machine, which slave shaft extends in a torsional relationship with the main shaft. The device includes a first timing pulley mounted on the main shaft, a second timing pulley mounted on the slave shaft and a timing belt extending between the first and second timing pulleys in a twisted form.

9 Claims, 6 Drawing Sheets

POWER TRANSMISSION DEVICE FOR SEWING MACHINE

BACKGROUND OF THE INVENTION

1. Field of the Invention

The present invention relates to a power transmission device for sewing machines, and in particular, to a power transmission device for transmitting rotation of a drive shaft or for transmitting rotation of a main shaft to a slave shaft that extends within a plane parallel to the plane of the drive shaft, but is not parallel to the drive shaft. Such a relationship between the drive shaft and the slave shaft is known as a "torsional relationship."

2. Description of the Related Art

A known sewing machine includes a plurality of sewing heads each having an upper shaft for driving a sewing needle and a thread take-up lever, and a lower shaft for driving a shuttle. The lower shaft normally extends in parallel with the upper shaft. The upper shaft and the corresponding lower shaft are coupled to each other by means of pulleys and a timing belt, so that the upper and lower shafts can be driven in synchronism with each other. A single main shaft extends through a plurality of gear boxes that correspond to the plurality of the sewing heads at a right angle relative to the upper and lower shafts. The main shaft is driven by a drive source, such as a motor. A plurality of bevel gears are mounted on the main shaft at a position within the respective gear boxes. A bevel gear is mounted on one end of the upper shaft and is positioned within the corresponding gear box to engage one of the bevel gears of the main shaft. As a result, when the drive shaft rotates, the rotation of the drive shaft is transmitted to the upper shaft of each sewing head and is then transmitted to the lower shaft by means of the timing belt.

The drive shaft and each of the upper shafts or slave shafts in the known sewing machine are positioned in a torsional relationship with each other. Therefore, the bevel gears are used as a power transmission device in the known sewing machine.

However, because of the incorporation of the bevel gears in the known sewing machine, significant vibrations and noise are produced from each pair of engaging bevel gears, in particular when the drive shaft rotates at high speed. Therefore, the working environment may become uncomfortable and noisy for the operator.

SUMMARY OF THE INVENTION

It is, accordingly, one object of the present invention to teach improved power transmission devices for a sewing machine, in which the rotation of a drive shaft can be transmitted to a slave shaft without producing substantial vibrations or noise.

According to the present invention, improved power transmission devices are taught that transmits rotation of a main shaft or a drive shaft of a sewing machine to a slave shaft of the sewing machine. The slave shaft extends in a torsional relationship with the drive shaft. The slave shaft may serve to drive a needle bar and a thread take-up lever or may serve to drive a shuttle. The power transmission device may include a first timing pulley mounted on the drive shaft, a second timing pulley mounted on the slave shaft, and a timing belt extending between the drive shaft and the slave shaft in a twisted form.

Therefore, the rotation of the drive shaft may be transmitted to the slave shaft by means of the timing belt, so that vibrations and/or noise may be substantially reduced in comparison with known sewing machines that utilize gears as a power transmission device.

In a preferred embodiment, the positional relationship between the first timing pulley and the second timing pulley is determined such that the timing belt will not shift in a sideways direction when the rotation of the drive shaft is transmitted to the slave shaft.

Such a positional relationship may be achieved, for example, by positioning the rotational axis of the first timing pulley perpendicular to the rotating axis of the second timing pulley. Further, the lateral surface of the timing belt at the position in which the leading portion of the timing belt departs or separates from the first timing pulley is aligned with one peripheral edge of the timing belt at a position where the timing belt first contacts the second pulley as shown in FIG. 3.

Therefore, damage to the timing belt may be substantially reduced even during the extended operation of the sewing machine.

In another preferred embodiment, the transmission device further includes a second slave shaft that may extend parallel to the first slave shaft. A second timing belt may be provided to transmit rotation of the first slave shaft to the second slave shaft. Therefore, one of the first and second slave shafts may serve to drive the needle bar and the thread take-up lever, and the other of the first and second slave shafts may serve to drive the shuttle.

Other objects, features and advantages of the present invention will be readily understood after reading the following detailed description together with the accompanying drawings and the claims.

DETAILED DESCRIPTION OF THE INVENTION

A power transmission device is taught that may reduce vibrations and noise during transmission of rotation of a drive shaft of a sewing machine to a slave shaft of the sewing machine, in particular, to a slave shaft that is positioned in a torsional relationship with the drive shaft. Preferably, the rotation of the drive shaft is transmitted to the slave shaft by means of timing pulleys mounted on the drive shaft and the slave shaft, respectively, and a timing belt extending between the timing pulleys in a twisted form. Because the slave shaft rotates by means of the timing belt, teeth engaging sounds that are common to known devices incorporating bevel gears cannot be produced, because the timing belt has no teeth.

In a representative embodiment of the present invention, the positional relationship between the first timing pulley and the second timing pulley is determined such that the timing belt may not shift in a sideways direction during transmission of rotation from the drive shaft to the slave shaft.

Therefore, damage to the timing belt may be substantially reduced even during the extended operation of the sewing machine.

Figure 3:
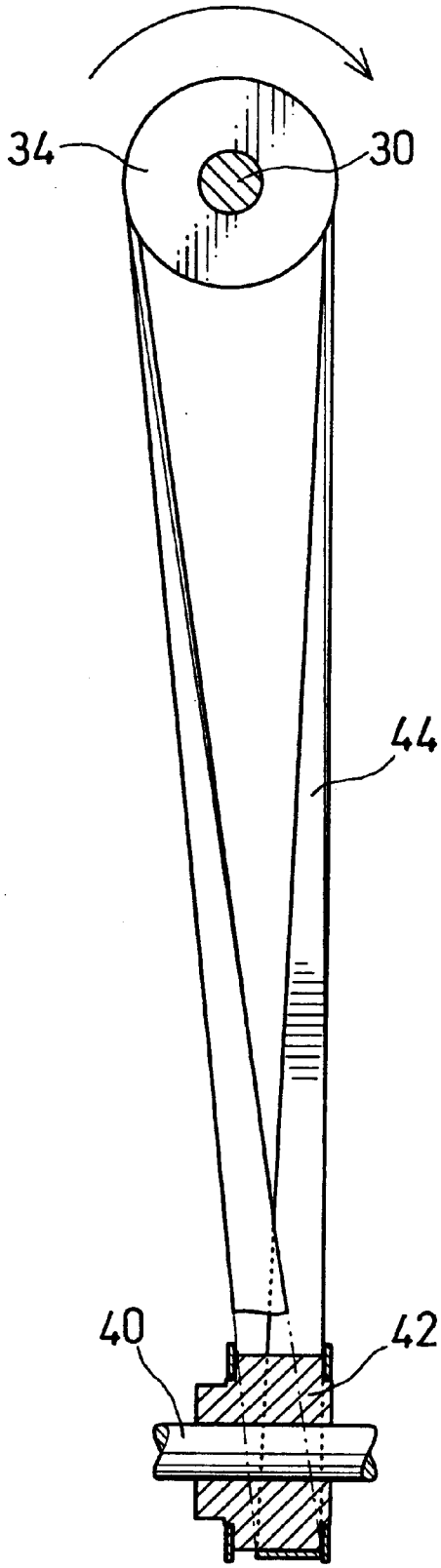
FIG. 3 is a right side view of FIG. 2.

Preferably, such a positional relationship is achieved, for example, by positioning the rotational axis of the first timing pulley perpendicular to the rotating axis of the second timing pulley. Further, the lateral surface of the timing belt at the position in which the leading portion of the timing belt departs or separates from the first timing pulley is aligned with one peripheral edge of the timing belt at a position where the timing belt first contacts the second pulley as shown in FIG. 3.

In another representative embodiment, a multi head sewing machine is taught that includes a single drive shaft and a plurality of sewing heads, each having a slave shaft.

The slave shaft may serve to drive a needle bar and a thread take-up lever or to drive a shuttle.

In another representative embodiment, the power transmission device further includes a second slave shaft positioned in parallel to the first slave shaft, and a second timing belt for transmitting rotation of the first slave shaft to the second slave shaft. Therefore, the first slave shaft can be used to drive the needle bar and the thread take-up lever and the second slave shaft can be used to drive the shuttle.

Each of the additional features and method steps disclosed above and below may be utilized separately or in conjunction with other features and method steps to provide improved sewing machines and methods for designing and using such sewing machines. A representative example of the present invention, which example utilizes many of these additional features and method steps in conjunction, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detail description may not be necessary to practice the invention in the broadest sense, and are instead taught merely to particularly describe representative examples of the invention.

Preferably, another timing pulley 34 is fixed to the upper shaft 30 adjacent to the timing pulley 32. A single main shaft 40 may extend through the machine frame 10 and below the sewing heads 20. More specifically, the main shaft 40 may extend at a substantially right angle relative to each upper shaft 30 and each lower shaft 36 A plurality of timing pulleys 42 (only one is shown in the drawings for purposes of clarity) may be fixed to the main shaft 40. Each of the timing pulleys 42 may be positioned directly below the timing pulley 34 of the upper shaft 30 of each of the dewing heads 20 A timing belt 44 may extend between each timing pulley 42 and its corresponding timing pulley 34 in a twisted form.

An upper shaft 30 may be rotatably supported within the machine arm 24. A lower shaft 36 may be rotatably supported within the bed 22 and may extend in parallel to the upper shaft 30. Timing pulleys 32 and 38 may be fixed to the upper shaft 30 and the lower shaft 36, respectively. An endless timing belt 39 may extend between the timing pulleys 32 and 38, so that the upper shaft 30 and the lower shaft 36 can rotate in synchronism with each other. Thus, the rotation of the upper shaft 30 can be transmitted to the selected one of the needle bars 12 and one of the thread take-up levers 14 by means of a drive mechanism (not shown) disposed within the front portion of the machine arm 24. On the other hand, the rotation of the lower shaft 36 can be transmitted to a shuttle 16 that is disposed within the front portion of the bed 22.

Figure 1:
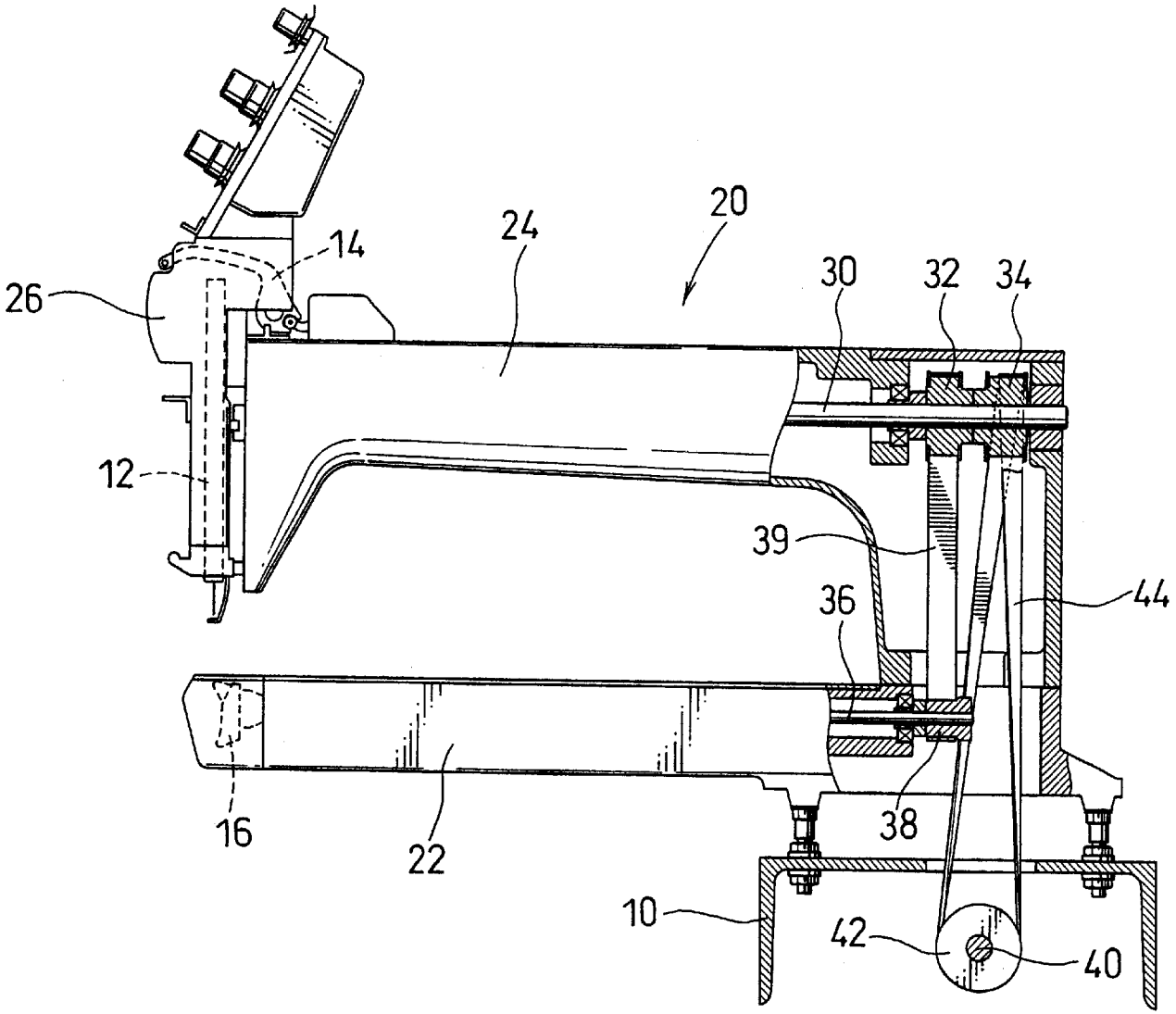
FIG. 1 is a sectional side view of one of sewing heads of a representative sewing machine having an improved power transmission device.

Representative embodiments of a sewing machine will now be described with reference to the drawings, FIG. 1 illustrates a side view of a one of the sewing heads 20 of a multi-bead sewing machine. Thus, a plurality of sewing heads 20 may be disposed on a machine frame 10 in juxtaposed relationship with each other. Each of the sewing heads 20 may generally comprise a bed 22 and a machine arm 24. A plurality of needle bars 12 (only one is shown in the drawings for purposes of clarity) and a corresponding number of thread take-up levers 14 (only one is shown in the drawings for purposes of clarity) may be supported on a support bracket 26. Preferably, the support bracket 26 is laterally shiftably mounted on a front end of each of the sewing heads 20. Therefore, one of the needle bars 12 and the corresponding one of the thread take-up levers 14 that are to be driven can be selected in response to the shift position of the support bracket 26.

Figure 2:
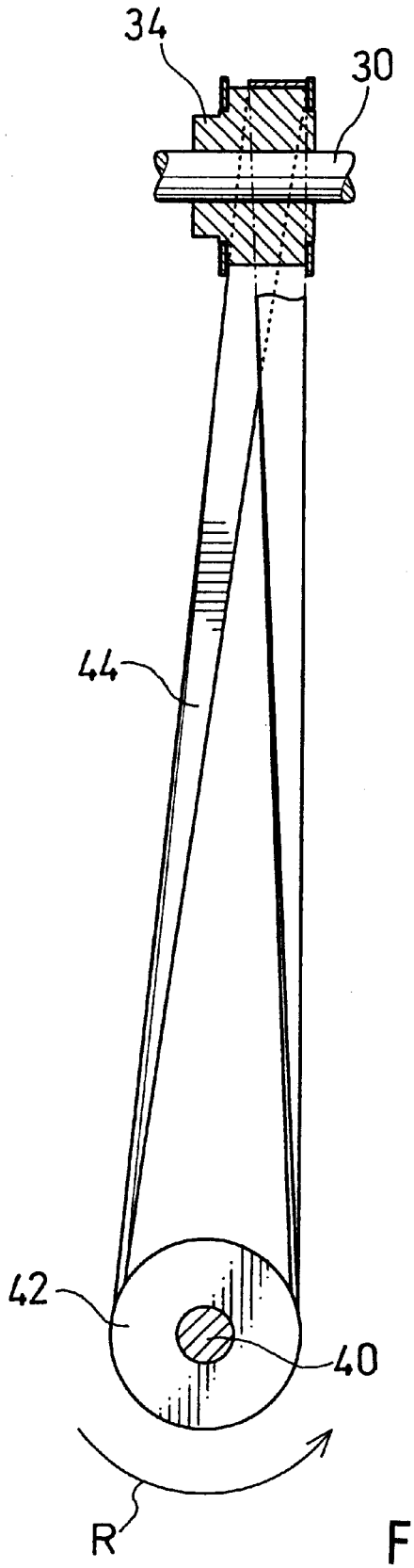
FIG. 2 is an enlarged view of the power transmission device.
Figure 4:
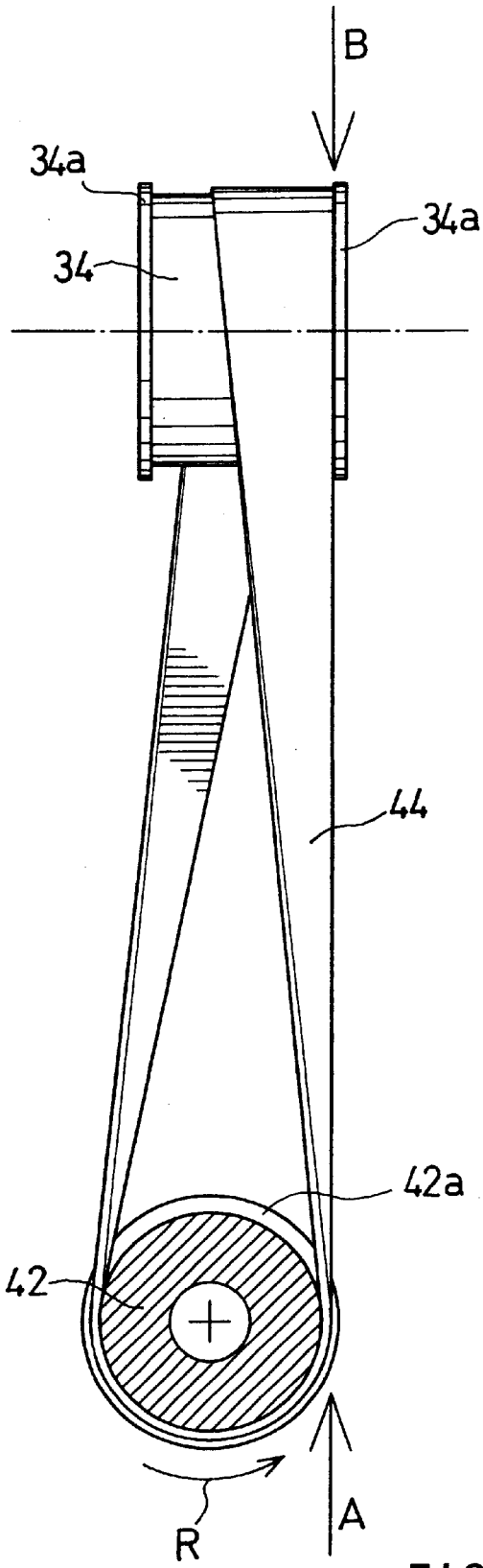
FIG. 4 is a view similar to FIG. 2 but showing a preferred positional relationship of the timing pulleys and the timing belt.

The main shaft 40 may be caused to rotate in one direction as indicated by arrow R in FIGS. 2 and 4 by a drive source, such as a motor (not shown). The rotation of the main shaft 40 may be transmitted to the upper shaft 30 of each of the sewing heads 20 by the timing belt 44. Subsequently, the rotation of the upper shaft 30 may be transmitted to the lower shaft 36 by the timing belt 39. Thus, by means of the timing pulleys 34 and 42 and the timing belt 44, the rotation of the main shaft 40 may be transmitted to each upper shaft 30 that is in a torsional relationship with the main shaft 40. Therefore, when the sewing machine is operated, vibrations and noise that may be produced during transmission of rotation of the main shaft 40 to the upper shaft 30 can be considerably reduced.

Preferably, the positional relationship between the timing pulley 34 of each of the upper shafts 30 and the corresponding timing pulley 42 of the main shaft 40 is determined as shown in FIGS. 2 to 4.

Figure 5:
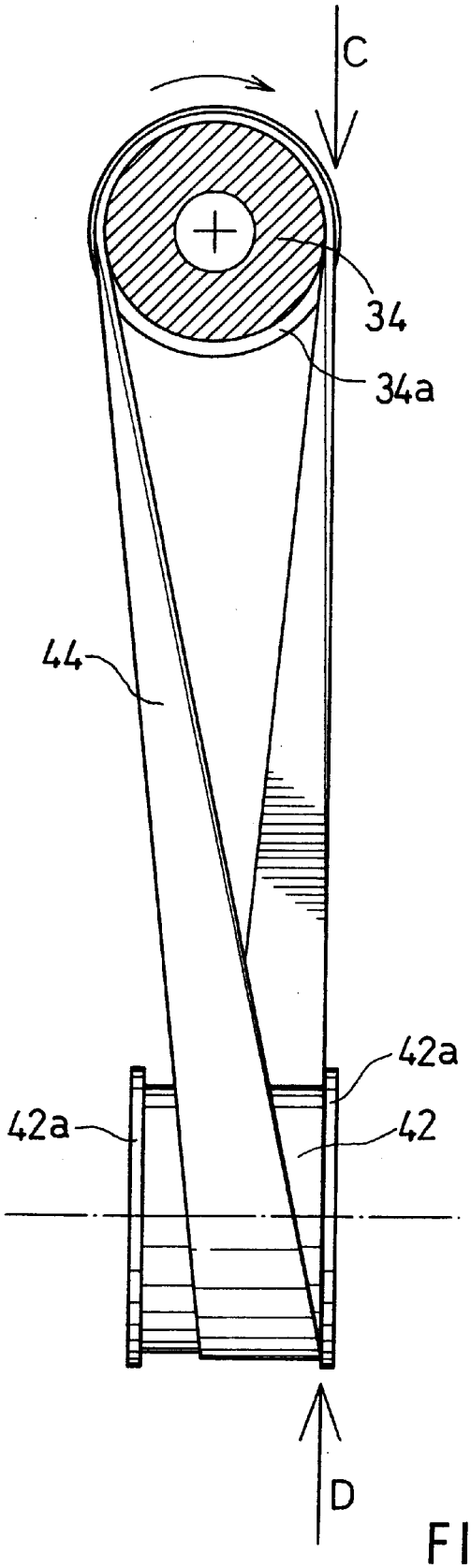
FIG. 5 is a right side view of FIG. 4.

FIGS. 2 and 4 show an enlarged view of the timing pulleys 34 and 42 and the timing belt 44 and a schematic view of the same. The lateral outer surface A of the timing belt 41 at the position in which the timing belt 41 separates or departs from the timing pulley 42 is aligned with one peripheral edge B. of the timing belt 44 adjacent to one of flanges 34*a* of the timing pulley 34 on the same side as the lateral outer surface A. On the other hand, as shown in FIGS. 3 and 5, which are right side views of FIGS. 2 and 4, respectively, the lateral outer surface C of an outer surface of the timing belt 44 at the position in which the timing belt 44 separates or departs from the timing pulley 34 is aligned with one peripheral edge D of the timing belt 44 adjacent to one of flanges 42*a* of the timing pulley 42 on the same side as lateral outer surface C.

Because the relationship between the timing pulleys 34 and 42 are selected as described above, the timing belt 44 may be prevented from shifting in the sideways or widthwise direction when the main shaft 40 is driven. In addition, adjustments to position of the timing pulleys 34 and 42 relative to each other can be performed prior to fixing them in position by sliding the timing pulleys 34 and 42 along the upper shaft 30 and the main shaft 40, respectively, if the upper shaft 30 and the lower shaft 36 are fixed in position.

Figure 6:
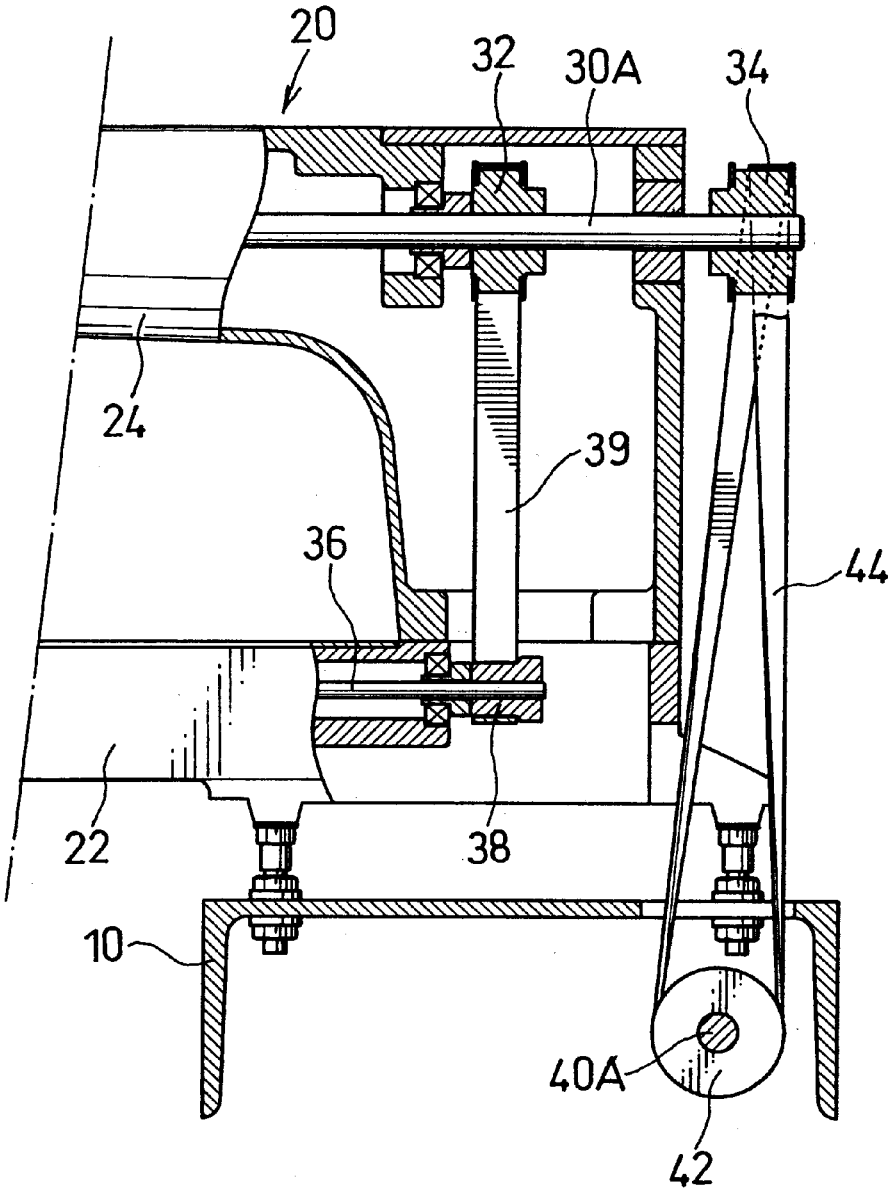
FIG. 6 is a sectional side view of one of the sewing heads of a second representative sewing machine.

A second preferred representative embodiment will now be described with reference to FIG. 6. This representative embodiment is different from the first representative embodiment in that an upper shaft 30A, which corresponds to the upper shaft 30 of the first representative embodiment, extends outward from each sewing head 20 and that the main shaft 40A, which corresponds to the main shaft 40 of the first embodiment, is positioned directly below the extended end portion of the upper shaft 30A. In other respects, the construction of the second representative embodiment is the same as the first representative embodiment. The positional relationship between the timing pulley 34 fixed to the upper shaft 30 and the timing pulley 42 fixed to the lower shaft 40 may be determined to be the same as the first representative embodiment.

With this arrangement, a substantial part of the timing belt 44 may be exposed to the outside of the sewing head 20. Therefore, the timing belt 44 can be easily exchanged for new one during maintenance work. Preferably, a protective cover (not shown) is removably attached to the rear side of the machine arm 24 so as to cover the timing pulley 34 and the timing belt 44.

Although the upper shafts 30 are directly driven by the main shaft 40 by means of a belt-type transmission device comprising timing pulleys 34 and 40 and timing belt 44 in the above first and second representative embodiments, the lower shafts 36 may be directly driven by the main shaft 40. In this alternative configuration, the rotation of the main shaft 40 may be transmitted to the lower shafts 36 via the timing belts 44, and the rotation of the lower shafts 36 are then transmitted to the corresponding upper shafts 30 via the timing belts 39.

Further, although the present invention has been described in connection with a multi-head sewing machine having a plurality of machine arms each having a movable support bracket for a needle bar and a thread take-up lever, the present invention may also be applied to a multi-head sewing machine having a single frame on which a plurality of movable support brackets are mounted.

What is claimed is:

1. A power transmission device for transmitting rotation of a drive shaft of a sewing machine to a slave shaft of the sewing machine, which slave shaft extends in a torsional relationship with the drive shaft, comprising:

a first timing pulley mounted on the drive shaft;

a second timing pulley mounted on the slave shaft;

a timing belt extending between the first and second timing pulleys; and a second slave shaft positioned in parallel to the first slave shaft, and a second timing belt for transmitting rotation of the first slave shaft to the second slave shaft.

2. A power transmission device as in claim 1, wherein the positional relationship between the first timing pulley and the second timing pulley is determined such that the timing belt does not shift in a sideways direction during transmission of rotation from the drive shaft to the slave shaft.

3. A power transmission device as in claim 2, wherein an outer lateral surface of the timing belt at a position in which the timing belt departs from one of the first and the second timing pulleys is aligned with one edge of the timing belt at a position at which the timing belt first contacts the other of the first and the second timing pulleys.

4. A power transmission device as in claim 1, wherein the drive shaft extends substantially at a substantially right angle relative to the slave shaft.

5. A power transmission device as in claim 1, wherein the slave shaft serves to drive a needle bar and a thread take-up lever.

6. A power transmission device as in claim 1, wherein the slave shaft serves to drive a shuttle.

7. A power transmission device as in claim 1, wherein one of the first and second slave shafts serves to drive a needle bar and a thread take-up lever, and the other of the first and second slave shafts serves to drive a shuttle.

8. A sewing machine, comprising:

a drive shaft;

a first timing pulley mounted on the drive shaft;

a slave shaft;

a second timing pulley mounted on the slave shaft, a rotational axis of the first timing pulley being positioned to be perpendicular to a rotational axis of the second timing pulley;

a timing belt extending between the first timing pulley and the second timing pulley in a twisted form; and a second slave shaft positioned in to the first slave shaft, and a second timing second slave shaft.

9. A sewing machine as in claim 8, wherein an outer lateral surface of the timing belt at a position in which the timing belt departs from one of the first and the second timing pulleys is aligned with one edge of the timing belt at a position at which the timing belt first contacts the other of the first and the second timing pulleys.

* * * * *